United States Patent [19]

Parks

[11] 3,993,265

[45] Nov. 23, 1976

[54] PLASTIC BOBBIN OR QUILL

[75] Inventor: Robert F. Parks, Greenville, S.C.

[73] Assignee: Steel Heddle Manufacturing Company, Greenville, S.C.

[22] Filed: Mar. 17, 1975

[21] Appl. No.: 558,951

[52] U.S. Cl. ..... 242/118.32; 264/51

[51] Int. Cl.[2] ..... B65H 75/08; B65H 75/18

[58] Field of Search..... 242/118.32, 118.3, 118.31; 264/51, 53, 54

[56] References Cited

UNITED STATES PATENTS

| | | | |
|---|---|---|---|
| 2,605,979 | 8/1952 | Gartrell | 242/118.32 |
| 2,666,599 | 1/1954 | Battersby | 242/118.32 |
| 2,793,822 | 5/1957 | Consoletti | 242/118.32 |
| 2,967,026 | 1/1961 | Deventer | 242/118.32 X |
| 3,190,580 | 6/1965 | Guerin et al. | 242/118.32 |
| 3,268,636 | 8/1966 | Angell, Jr. | 264/51 |
| 3,306,960 | 2/1967 | Weissman et al. | 264/51 |
| 3,307,801 | 3/1967 | Bagwell, Jr. et al. | 242/118.3 |
| 3,719,441 | 3/1973 | Spaak et al. | 264/51 X |
| 3,793,415 | 2/1974 | Smith | 264/51 X |

*Primary Examiner*—Stanley N. Gilreath
*Attorney, Agent, or Firm*—Bailey, Dority & Flint

[57] ABSTRACT

A quill or bobbin for holding a supply of yarn wound thereon in overlapping layers having an elongated barrel and an enlarged butt end integral therewith. The entire quill is molded utilizing a mixture of thermoplastic material and a blowing agent. A substantial portion of the barrel is solid and has a hardened surface with a less dense interior center core defined by set microscopic bubbles. An axial bore extends through the butt end of the quill and a dense hardened interior surface encompasses the bore.

4 Claims, 2 Drawing Figures

PLASTIC BOBBIN OR QUILL

BACKGROUND OF THE INVENTION

The present invention relates to plastic bobbins and more particularly to a plastic bobbin having a barrel that is solid for a substantial portion thereof with a minimum of stresses therein so as to insure that the bobbin maintains its desired shape and configuration during manufacture and use thereof.

The terms quill and bobbin are used interchangeably throughout this application since such are often used to mean the same thing in the textile industry. Plastic quills or bobbins have been manufactured prior hereto but have not generally been commercially successful in the United States. One problem encountered in manufacturing plastic bobbins heretofore is that stresses often develop in the barrel of the bobbin during molding which tend to distort the shape of the bobbin. Attempts have been made to overcome these problems encountered in molding plastic bobbins and one such attempt utilized an elongated mandrel that extended for substantially the entire length of the barrel in axial alignment with the mold cavity. The problem encountered in such a device is that during the molding process, the plastic tends to expand and contract during the heating and cooling stages. This often caused the elongated mandrel to deviate from the center axis of the mold producing an uneven wall thickness in the bobbin. In an attempt to overcome the above problem a mandrel was used which extended entirely through the mold. In this way, both ends of the mandrel could be secured preventing such from deviating from the longitudinal axis. However, this presented a problem in that it produced a bobbin having an axial bore through the entire length of the barrel reducing the strength of the barrel.

The exterior dimension of a bobbin is generally dictated by the particular shuttle or apparatus in which such is being utilized. Accordingly, bobbin manufacturers have very little latitude in changing the exterior dimension and shape of the bobbin. The bobbin constructed in accordance with the present invention, accordingly, has the same exterior shape as conventional wooden bobbins and/or plastic bobbins now being utilized. Examples of plastic bobbins are disclosed in U.S. Pat. Nos. 2,605,979 granted to Gartrell on Aug. 5, 1952, 2,967,026 granted to Deventer, III, on Jan. 3, 1961 and 3,190,580 granted to Guerin, et al on June 22, 1965. As can be seen, each of these plastic bobbins has a hollow core extending through the barrel thereof minimizing the strength thereof. U.S. Pat. No. 3,268,636 granted to Angell, Jr. on Aug. 23, 1966, discloses a method and apparatus for injection molding foam plastic articles. As is disclosed, a blowing agent is mixed with a thermoplastic material to produce articles such as bowling pins and the like. Similarly, U.S. Pat. No. 3,776,989, granted to Annis, Jr., et al on Dec. 4, 1973, discloses another method for injection molding articles of foam material utilizing a screw extruder.

SUMMARY OF THE INVENTION

The invention pertains to a quill for holding a supply of yarn wound thereon in overlapping layers having an elongated barrel and an enlarged butt end integral with the barrel. The butt end has spaced circumferential grooves provided thereon for accommodating retaining rings. Such is conventional on the majority of bobbins and quills. The entire quill is molded from a mixture of thermoplastic material and a blowing agent. The barrel has a solid portion extending from a tip end thereof towards the butt. A dense exterior hardened surface is provided on the barrel and the butt and a less dense interior center core extends through the solid portion of the barrel defined by miscroscopic bubbles. The butt has an axial bore extending therethrough which terminates in the barrel. A hardened interior surface encompasses the axial bore. In one particular application, the thermoplastic material is a polyester resin such as polybutylene terephahatate and the blowing agent is 5-phenyltetrazole. A fiberglass filler is also inserted within the mixture to add strength to the bobbin.

Accordingly, it is an object of the present invention to provide an improved plastic quill that has a minimum of stresses therein so that the bobbin will maintain its overall physical characteristics and dimensions throughout use.

Another important object of the present invention is to provide a plastic bobbin which has a hardened exterior surface on the barrel and butt as well as a hardened interior surface encompassing an axial bore extending through the butt.

Still another important object of the present invention is to provide a bobbin which has a solid core portion extending from the tip end thereof for a substantial length produced by microscopic bubbles formed during the molding thereof.

These and other objects and advantages of the invention will become apparent upon reference to the following specification, attendant claims and drawing.

DESCRIPTION OF A PREFERRED EMBODIMENT

The quill constructed in accordance with the present invention is manufactured on a conventional injection molding machine wherein a mixture of polyester resin, fibrous filler, and a blowing agent is fed into a hopper above a reciprocating screw molding machine. The screw molding machine has a heated barrel which has an input heated zone of approximately 475° F., an intermediate heated zone of approximately 485° F, and an exit temperature zone, of approximately 480° F. As the mixture is fed through the heated barrel by the rotating screw, pressure is built up near the exit zone due to the feeding of the plastic into the melt zone and back pressure held on the melt by the injection cylinder.

While the blowing agent begins to decompose bubbles do not form in the melt due to this pressure. This is similar to a carbonated beverage which has no bubbles in it until the pressure is relieved by opening the cap of the bottle. Injecting the melt containing the decomposed blowing agent into the cavity is similar to opening the cap on the beverage bottle as it reduced the pressure allowing bubbles to form in the plastic.

A mold is attached to the end of the extruder which has a cavity shaped to the desired shape of the quill to be manufactured. A mandrel extends into the cavity of the mold to provide a bore which will extend through the butt end of the quill and terminate in the barrel portion. As the heated mixture is fed into the cavity of the mold, any air trapped in the mold when closed is vented through small vents provided therein. The vents of the mold are of such diameter as to permit escape of the trapped air, but are too small to permit the molten polyester resin to flow therethrough.

Due to the decomposition of the blowing agent, the mixture in the mold tends to expand until it begins to solidify upon cooling which prevents any further expansion. When the mold begins to cool, a dense, hard other layer is produced with the core of the bobbin particularly extending through the solid portion of the barrel being less dense and of a cellular construction defined by microscopic bubbles produced by the blowing agent. These microscopic bubbles expand during the cooling process minimizing the stresses in the bobbin which would normally tend to distort the shape of the bobbin if such were constructed of pure thermoplastic resin. The expansion of the bubbles compensates for the normal shrinkage of the plastic material.

In one particular application, the thermoplastic resin is polybutylene tetrephahatate and the blowing agent is 5-phenyltetrazole and the fibrous filler is fiberglass. The ratio of the mixture is 69.5% of polyester resin, 30% fibrous filler and 0.5% of blowing agent by weight.

Figure 1:
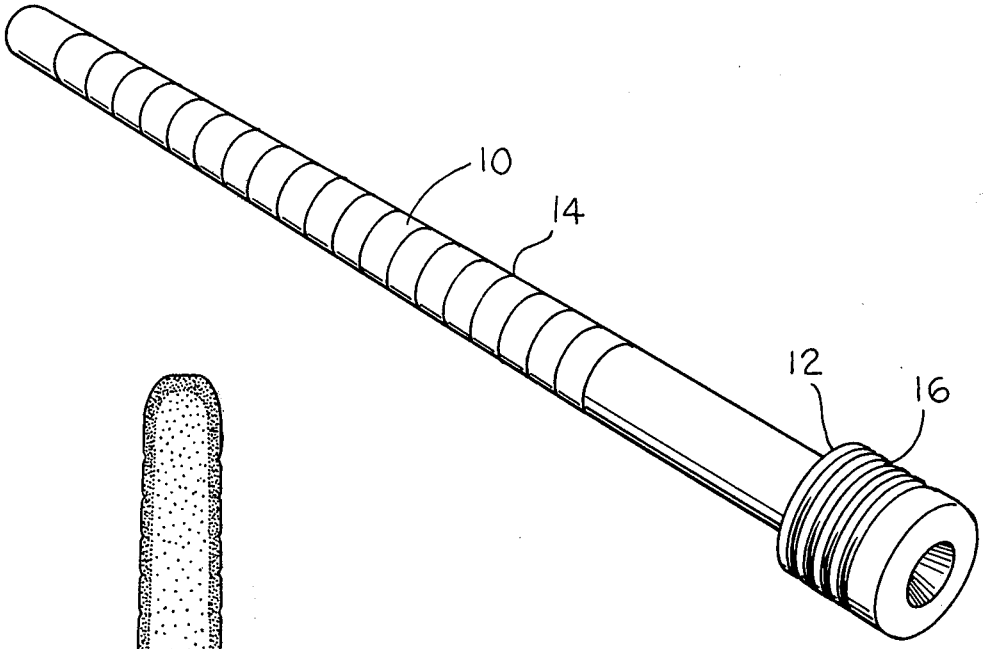
FIG. 1 is a perspective view of a bobbin constructed in accordance with the present invention with parts cut away for purposes of clarity.

The bobbin as shown in FIG. 1 has an elongated barrel 10 which has a gradual taper from adjacent the butt 12 of the bobbin to the tip end. A plurality of longitudinally spaced circumferential grooves 14 are provided on the barrel for aiding in retaining yarn thereon.

The butt 12 of the quill has a larger diameter than the barrel 10 and has spaced circumferential grooves 16 provided therein for receiving the conventional retaining rings.

Figure 2:
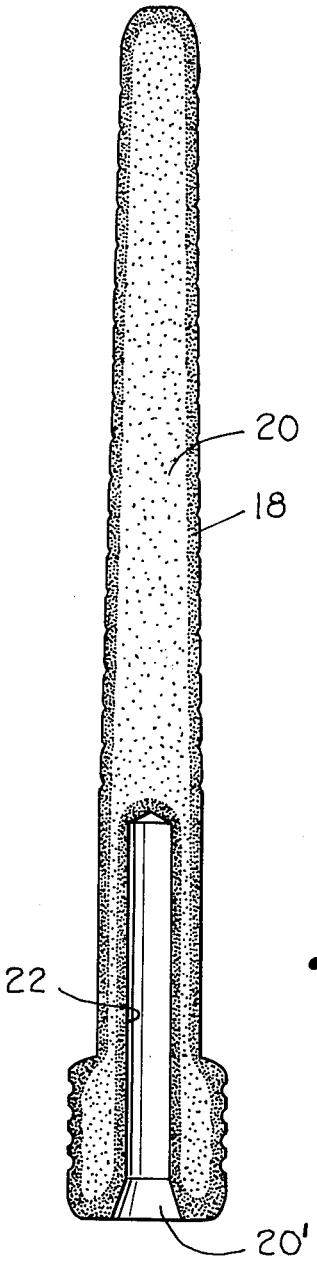
FIG. 2 is an elevational view of a bobbin sawed in half along its longitudinal axis.

As can be seen in FIG. 2, which illustrates a bobbin cut along its longitudinal axis, there is a dense exterior hardened surface 18 provided thereon. An inner cellular core 20 of the bobbin is less dense than the exterior surface. The cellular inner core is defined by set microscopic bubbles which were produced by the blowing agent during the molding process.

In testing the hardness of the exterior hardened surface 18 and the interior core 20 using a Barcol Impressor Test ASTM D-2583, the core 20 had a reading from 20 along the longitudinal axis to 60–62 intermediate the longitudinal axis and the exterior surface 18. The exterior hardened surface had a reading of 78–81.

An axial bore 20′ extends through the butt 12 of the bobbin and terminates in the barrel 10. The bore 20′ is encompassed by a dense hardened interior surface 22 which when tested for hardness produced a reading of 78–81.

One of the primary purposes of the bore 20′ is to provide a means for placing the bobbin on a supporting pin or rack. This in some cases, protects the yarn wound on the bobbin and in other cases, is simply a convenient method of storing a bobbin.

In one particular bobbin the length of the bobbin is eight inches and the length of the axial bore 20′ is 2 11/16 inches. The length of the barrel from adjacent the butt 12 to the tip is 6 15/16 inches, therefore, the axial bore 20′ extends into the barrel for 1⅝ inches.

It is important for the purpose of strength that the majority of the barrel 10 be solid.

While a preferred embodiment of the invention has been described using specific terms, such description is for illustrative purposes only, and it is to be understood that changes and variations may be made without departing from the spirit or scope of the following claims.

What is claimed is:

1. A quill of circular cross section for holding a supply of yarn wound thereon in overlapping layers having an elongated barrel and an enlarged butt end integral with said barrel, said butt end having spaced circumferential grooves provided thereon for accommodating retaining rings, said barrel being tapered from adjacent said butt toward the tip end thereof, the improvement comprising:

said entire quill being molded of a mixture of a thermoplastic material susceptible to softening and melting at high temperatures and a blowing agent which generates a gas for forming a cellular plastic material having microscopic bubbles when heated above a predeterined temperature, said barrel having a solid portion extending from the tip end thereof towards said butt, a dense exterior hardened surface provided on said barrel and said butt, a less dense interior cellular core extending through said solid portion of said barrel characterized by said microscopic bubbles retained therein, an axial bore extending through said butt of said quill extending toward said tip and terminating in said barrel, said bore extending into said barrel a distance less than half the length of said barrel whereby said solid portion comprises the majority of the barrel, a dense interior hardened surface encompassing said axial bore, said dense exterior hardened surface and said dense interior hardened surface providing axial support which aids in maintaining dimensional stability thus avoiding warping.

2. The quill as set forth in claim 1 wherein said thermoplastic material is of a polyester resin.

3. The quill as set forth in claim 1 wherein said thermoplastic material is polybutylene terephthatute and said blowing agent is 5-phenyltetrazole.

4. The filling quill as set forth in claim 1 wherein said mixture includes a fiberglass filler.

* * * * *